United States Patent [19]

Loibl et al.

[11] 4,114,679

[45] Sep. 19, 1978

[54] ARRANGEMENT FOR INTRODUCING A FLEXIBLE STARTER BAR INTO A CONTINUOUS CASTING PLANT

[75] Inventors: Lorenz Loibl, Baden; Werner Scheurecker, Linz, both of Austria

[73] Assignee: Vereinigte Osterreichische Eisen- und Stahlwerke - Alpine Montan Aktiengesellschaft, Linz, Austria

[21] Appl. No.: 769,153

[22] Filed: Feb. 16, 1977

[30] Foreign Application Priority Data

Feb. 26, 1976 [AT] Austria ..... 1415/76
Mar. 26, 1976 [AT] Austria ..... 2216/76

[51] Int. Cl.[2] ..... B22D 11/08
[52] U.S. Cl. ..... 164/426
[58] Field of Search ..... 164/274, 425, 426, 445, 164/446; 198/535, 536, 592, 780

[56] References Cited

U.S. PATENT DOCUMENTS 25,973 11/1859 Magee ..... 198/592
3,762,462 10/1973 Pietryka ..... 164/274

FOREIGN PATENT DOCUMENTS 1,961,443 6/1971 Fed. Rep. of Germany ..... 164/274
37,815 9/1947 Japan ..... 164/446

*Primary Examiner*—Francis S. Husar
*Assistant Examiner*—John S. Brown
*Attorney, Agent, or Firm*—Brumbaugh, Graves, Donohue & Raymond

[57] ABSTRACT

An arrangement for introducing a flexible starter bar, having a starter bar head, into a continuous casting plant with a mould and a strand guide located below the mould, has a lifting device for gripping and lifting the starter bar, and a displacement device designed as a car, arranged above the casting platform. The starter bar is introduced into the mould or into the strand guide by the displacement device, and a stationary conveying path, on which the starter bar is guided by the displacement device, has an arcuate front end part and an arcuate rear end part. The arcuate front end part is pivotable into and out of an introduction position.

26 Claims, 10 Drawing Figures

ARRANGEMENT FOR INTRODUCING A FLEXIBLE STARTER BAR INTO A CONTINUOUS CASTING PLANT

BACKGROUND OF THE INVENTION

The invention relates to an arrangement for introducing a flexible starter bar, having a starter bar head, into a continuous casting plant with a lifting means for gripping and lifting the starter bar and a displacement means designed as a car and arranged above the strand guide, by which car the lifted starter bar is introduced into the mould or into the strand guide below the mould.

According to German Auslegeschrift No. 1,961,443 an arrangement of this kind is known, wherein the displacement means is designed as a car that is movable on the casting platform. The car carries an endless conveyor belt that is guided over deflection rollers. This conveyor belt introduces the strand, which is carried in a cassette, into the mould. This known arrangement has the disadvantage that the rails for guiding the car are required to extend right up to the mould creating the danger of pollution and restricting the space in the operational region of the mould in an undesirable manner. Beside the car, the known arrangement requires a separate lifting means for lifting and a turning means for turning the cassette with the starter bar before placing it on the car.

In another known arrangement (Japanese Patent Publication No. Sho-41-21971), a derrick is provided on the casting platform, wherein the jib is provided with a driving roller and a deflection roller. When the foot end of the starter bar has been lifted to the casting platform, it is drawn to the mould via roller brackets and the derrick, wherein the starter bar sags between the rollers. The crane and the remaining transporting means restrict the space on the casting platform. Of course, such arrangements are only suitable for small plants with small dimensions for the strand cross-section.

SUMMARY OF THE INVENTION

The invention aims at avoiding the above-described disadvantages and difficulties and has the following objects: the reduction of the number of movable parts and the size of the arrangement; the specification of the drive means; the freeing of the region immediately surrounding the mould from structures impeding the operating personnel, thus reducing the risk of accidents; the simplification of the handling of the arrangement; an increase in operational safety; and an increase in the usefulness of the system for various dimensions of the cast strands.

According to the invention, these objects are achieved in that the starter bar is guided to a strand guiding path on a sliding or roller conveying path by a displacement means, the front and rear end parts of which conveying path are accurately designed. The arcuate front end part of the sliding or roller conveying path is pivotable into and out of the introduction position.

According to advantageous embodiments of the invention, the sliding or roller conveying path is arranged above the casting platform and the lifting means is designed as a cable pull or chain hoist united with the displacement means.

According to a preferred embodiment, the displacement means is movable between four positions on a horizontal sliding or roller conveying path, i.e. a rear starting position in which the foot end of the starter bar is lifted by a hook to the level of the sliding or roller conveying path, a pre-determined unlatch position which can be reached after movement in the direction towards the mould on the sliding or roller conveying path to a location in which the hook can be unlatched from the engagement position, a delivery position which can be reached after a movement in the direction away from the mould to a location between the rear starting position and the unlatch position and in which a catch of the displacement means can be engaged in the head end of the starter bar and a final position which can be reached after a movement in the direction toward the mould to a location in which the foot end of the starter bar is gripped by the driven rollers of the strand guide.

At the unlatch position on the sliding or roller conveying path, a link or the like can be provided for pivoting up the last foot member of the starter bar.

The cable pull or chain hoist carrying the hook, suitably is fastened on a tie-bar, the ends of which are guided in a stationary guide extending right to the horizontal sliding or roller conveying path. In the displacement means, a corresponding guide is provided to accommodate the tie-bar together with the hook in the lifted position, which guide is movable together with the displacement means.

Further preferred features of the invention comprise a stop on the displacement means which provides against premature unlatching of the hook and lateral guiding elements provided on the sliding or roller path, in particular vertical rollers.

According to one embodiment of the invention, the arcuately designed front end part of the sliding or roller conveying path is hinged to the stationary supporting construction by double guide rods.

If the sliding or roller conveying path is arranged on the casting platform, suitably a part of the sliding or roller conveying path is designed as an inclined plane extending from the casting platform to the pivotable arcuate end part.

It is advantageous if the arcuate front end part of the sliding or roller conveying path is motion-coupled with a strand guide part below the mould, which strand guide part can be pivoted out to create an introduction opening. This motion-coupling has the advantage that only a single adjustment means, such as a pressure medium cylinder, is necessary for the pivotal movement of the strand guide part and the arcuate front end part of the sliding or roller conveying path. Thereby, more space is available below the mould. Also the parts of the plant arranged there, such as the oscillating drive of the mould, are accommodated more easily and are more easily accessible.

The arcuate front end part of the sliding or roller conveying path can be connected with the pivotable strand guide part directly, via a guide rod connection or via a link guide.

According to a preferred embodiment, the strand guide part which can be pivoted out engages at the inner side with a sliding block in the link guide that is fixedly connected with the arcuate front end part of the sliding or roller conveying path.

BRIEF DESCRIPTION OF THE DRAWINGS

The invention shall now be described in more detail by way of a number of embodiments and with reference to the accompanying drawings, wherein.

DESCRIPTION OF EXAMPLARY EMBODIMENTS

Figure 1:
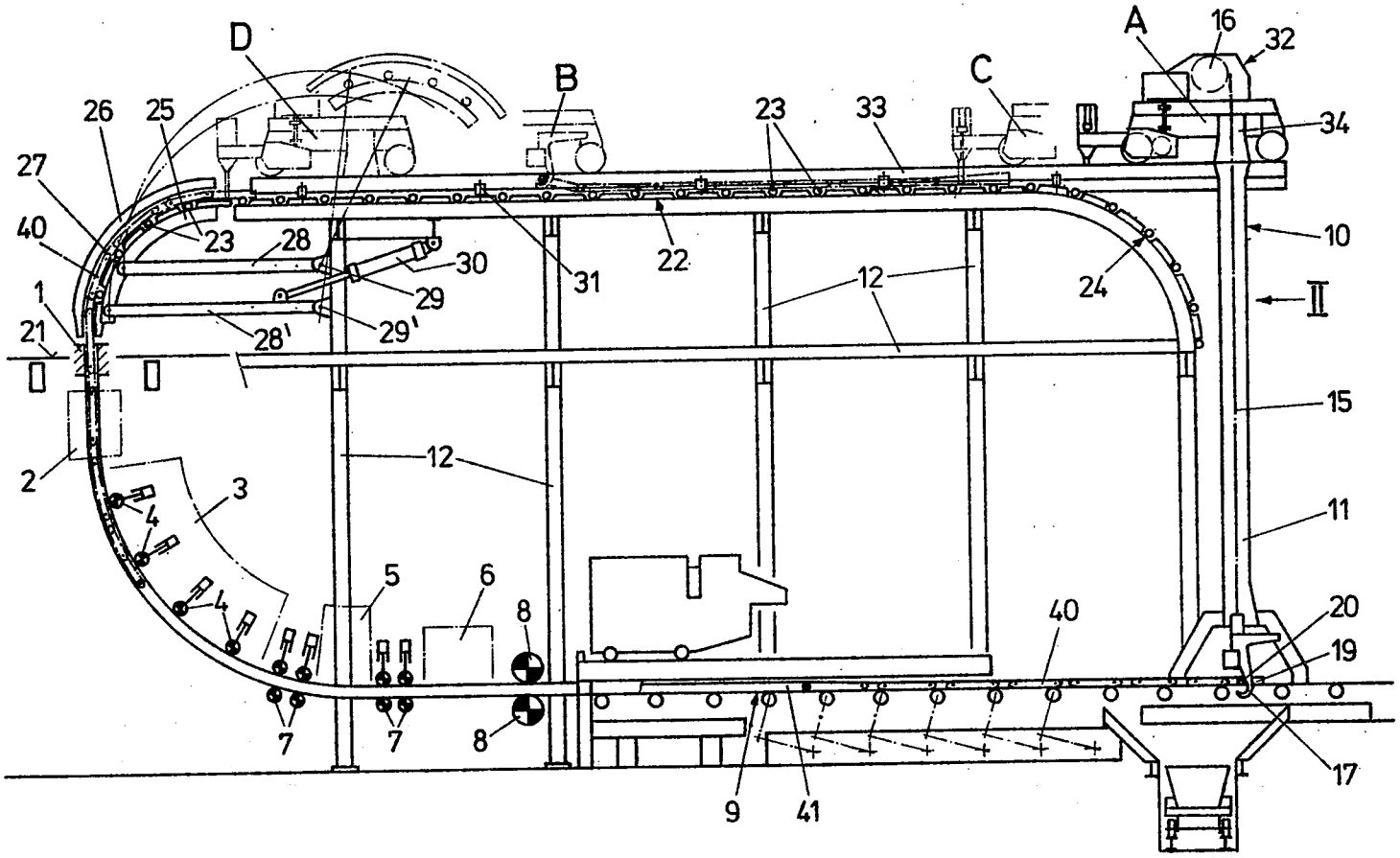
FIG. 1 is an overall view of the continuous casting plant in connection with the arrangement according to the present invention, which arrangement is mounted above the casting platform.
Figure 2:
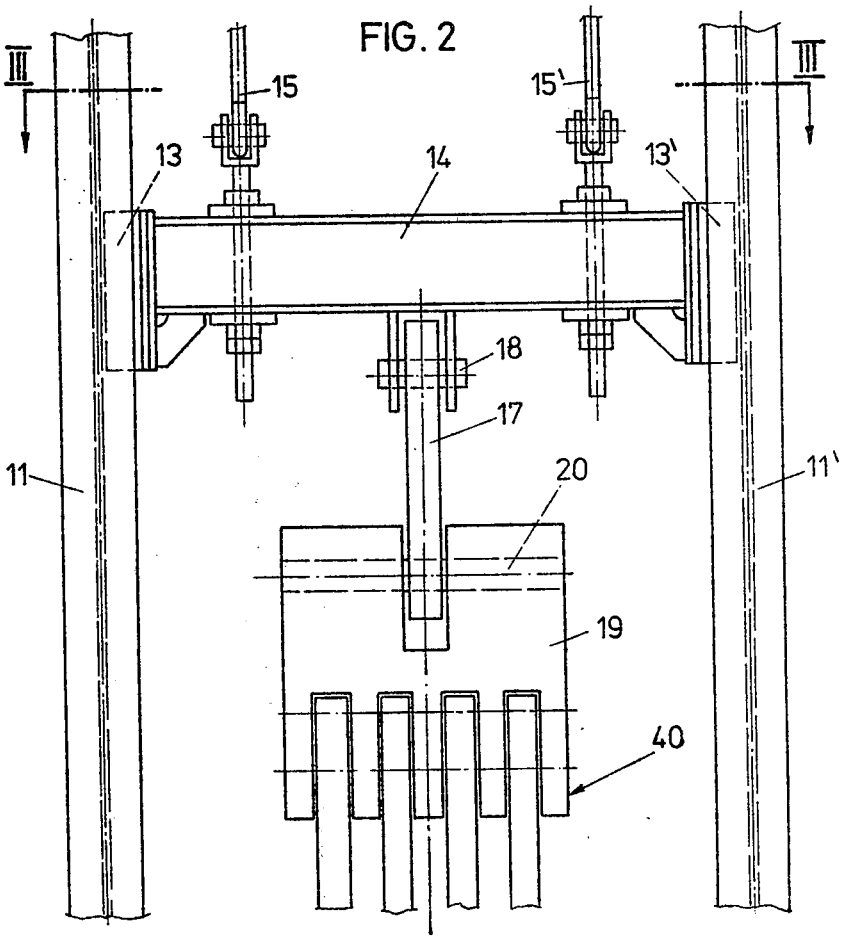
FIG. 2 is a partial view in the direction of the arrow II of FIG. 1, with the hook in a lifted position and the starter bar hanging thereon.

In FIG. 1, a continuous casting mould is denoted by 1, which mould is followed in the downward direction by a strand guide. In a bending zone 2 of the strand guide the cast strand is bent from the vertical into a circular arc. In the circular-arc-shaped guiding structure 3 following the bending zone, drivable rollers 4, which are adjustable to a starter bar, are mounted beside a number of non-driven rollers (not illustrated). The starter bar must be introduced into the strand guide through the mould from above to such an extent that the first drivable rollers grip it and convey it downward. (The starter bar is indicated in this position in the strand guide in broken lines). A straightening zone 5 of the strand guide is used to straighten the arcuately bent cast strand. A horizontal strand guide structure is denoted by 6. Between the circular-arc-shaped part of the strand guide, the straightening zone and the horizontal strand guiding structure, driving rollers 7 are provided.

At the end of the horizontal guiding path, further driving rollers 8 are provided. They are followed by a torch cutting roller path 9, that provides a torch cutting means at any desired position is divided the cast strand into pieces of a desired length and which also serves for cutting off the crop ends.

Figure 3:
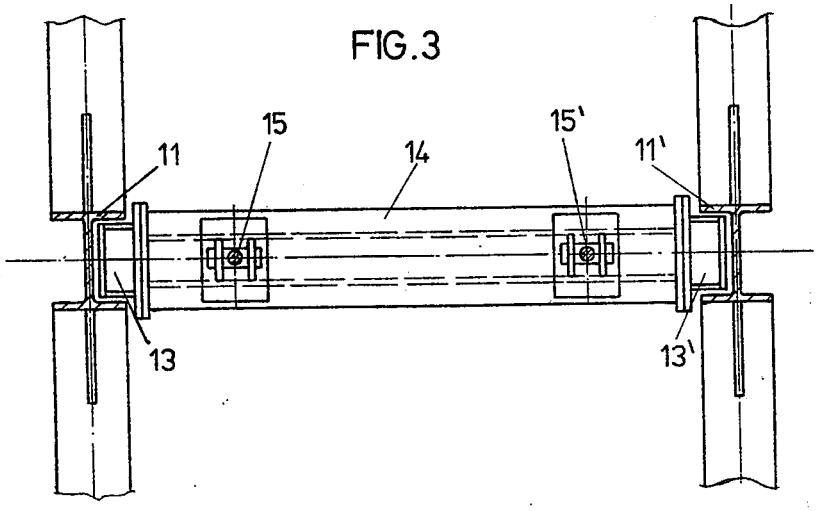
FIG. 3 is a section along line III—III of FIG. 2.

At the end of the torch cutting roller path, there is a lifting means, generally denoted by 10. It comprises two stationary uprights 11 and 11' which are secured to the steel structure 12 of the plant. They have a U-shaped profile, as can be seen from FIG. 3. In the profile, the ends 13 and 13' of a tie-bar 14 are vertically guided. Two lifting cables or lifting chains 15 and 15' are fastened to the tie-bar and are upwardly guided to a lifting mechanism 16. On the tie-bar there hangs a hook 17, which is pivotable about a bolt 18. By 19 the foot end of the strater bar is denoted, which end has a bolt 20.

In the plant according to the invention, a roller conveying path 22 is provided above the casting platform 21, which roller conveying path has a plurality of non-driven rollers 23. The free space above the casting platform 21 up to the roller conveying path 22 is so dimensioned that the casting platform is accessible from all sides without impediment.

The rear end part 24 of the roller path 22 is arcuately curved. It is also fastened to the steel structure 12. Also the horizontal middle part of the roller path is fixedly mounted on the steel structure 12. The front end part of the roller path comprises two inter-connected, arcuate segments 25 and 26, which enclose a passage gap 27 for the starter bar. On the lower segment 25, non-driven rollers 23 are mounted. The segment 25 is hinged to the structur 12 at parallel axes 29 and 29' by a double guide rods 28 and 28', and a hydraulic cylinder 30 enables a pivot movement from the position indicated in full lines to the position indicated in broken lines.

At both sides of the roller conveying path 22 in the horizontal part, vertical rollers 31 are provided which are used to guide the starter bar in the lateral direction.

Figure 4:
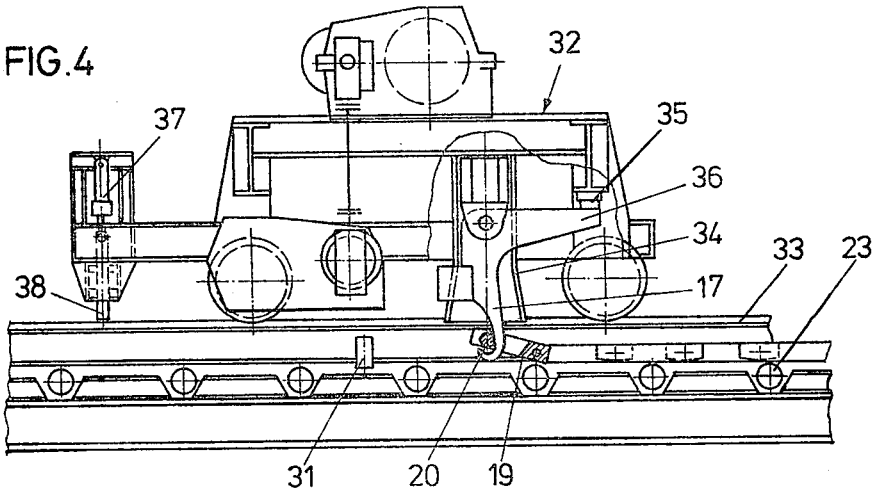
FIG. 4 shows the unlatching of the starter bar in at the unlatch position on the horizontal sliding or roller conveying path.
Figure 5:
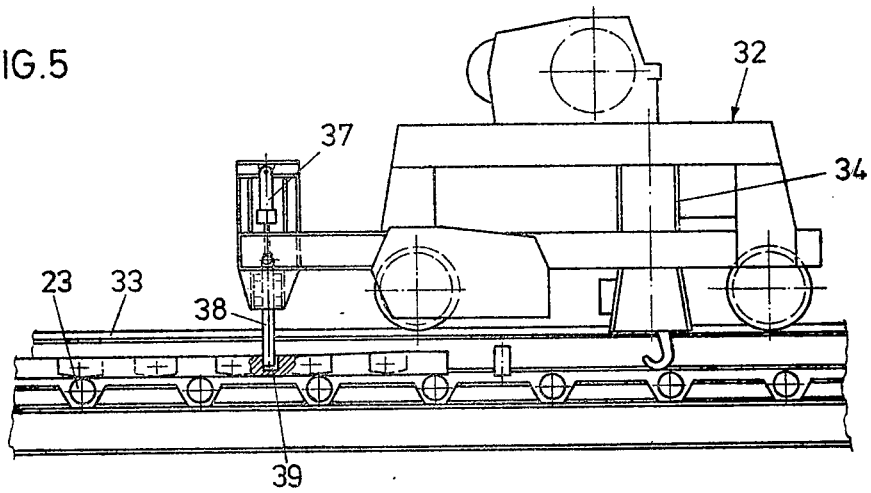
FIG. 5 shows the engagement position of the displacement means with the starter bar head in a like illustration.

Over the longitudinal extension of the roller path, a displacement means, generally denoted by 32 and designed as a car, is movable on rails 33, advantageously by means of a toothed rack drive. The car contains a vertical guide 34 which corresponds to the stationary guide 11, i.e. which has the same U-shaped profile. Furthermore, a stop 35 (FIG. 4) is provided on the car, which stop is contacted by a projection 36 of the hook 17 in the uppermost position thereof. This prevents a pivoting of the hook to the right and thus an undesired unlatching during the displacement of the car. Furthermore, a catch means 37 is provided on the car, in which a pin 38 is liftable and lowerable via a drive that is actuated by hand or mechanically.

The arrangement works in the following manner:

In FIG. 1, a starter bar is illustrated in a position, in which it is lying on the torch cutting roller path and is denoted by 40. Its head is connected with the crop of the hot strand 41, e.g. by a tong-like connection. The length of the starter bar reaches from the crop 41 to the lifting means. In this position, the foot end of the starter bar with the bolt 20 has reached the mouth of the hook. The car 32 is in the position illustrated in FIG. 1 in full lines, a so-called starting position denoted by A. Via end switches or the like the lifting mechanism is actuated and the flexible starter bar, which has individual members, is lifted until the hook 17 has been drawn into the guide 34 of the car 32. While the starter bar is being lifted, the starter bar head is separated from the crop end. The car 32, to which the hook 17 and the attached foot end 19 of the starter bar is connected, is then moved in the direction towards the mould causing the starter bar to lie on the arcuate rear end part 24 of the roller path and to be drawn over the horizontal part of the roller path. As soon as the car 32 has reached a position B, the last member of the starter bar is pivoted-up, e.g. by running over a link (not shown), and thus is unlatached from the hook 17. The empty car then is moved back from position B into a position C, where the catch 37 is actuated and the bolt 38 snaps into a recess 39 of the starter bar near the head end thereof. Then the arcuate segments 25 and 26 are pivoted from the position entered in broken lines into the position entered in full lines, so that they form a force guide for guiding the starter bar into the mould. The car is then moved from position C in the direction towards the mould into a final position D, the starter bar being pushed during this motion until its foot part has reached the driven rollers and is held by them. When the catch has been disengaged and the car has been moved back into the starting position A, the starter bar can be drawn into the mould until its head closes the bottom of the mould. The segments are then pivoted back and casting is started.

Figure 6:
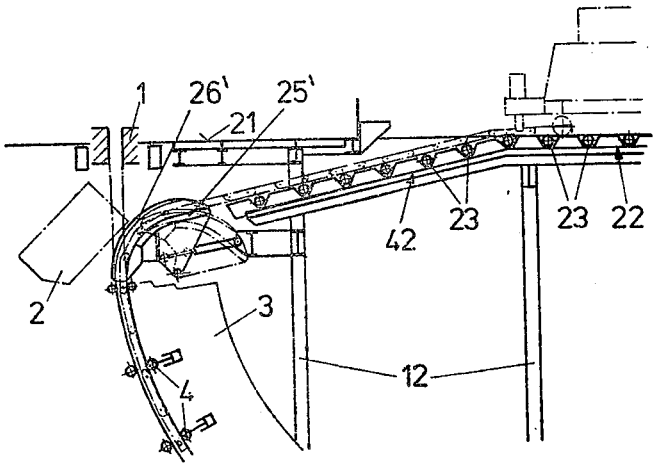
FIG. 6 shows the front region of a plant in an illustration analogous to that of FIG. 1, in which the transporting means according to the invention is arranged at the level of the casting platform.

In the modified embodiment according to FIG. 6, the roller path 22 is arranged at the level of the casting platform. A part of the roller part is designed as an inclined plane 42 and leads to a place below the mould which is accessible when the bending zone 2 has been pivoted out. In a similar manner as in the first embodiment, the transition between the inclined part 42 of the roller path and the introduction place on the guiding structure 3 is bridged by pivoting an arcuate double segment of conveying path 25' and 26'. Otherwise the arrangement works analogously to that of FIG. 1.

Figure 7:
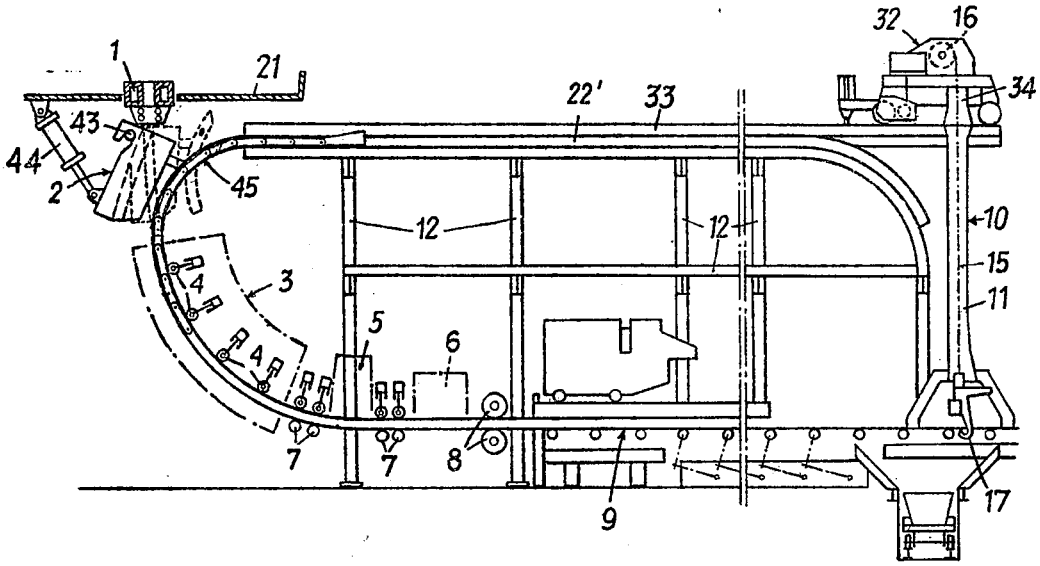
FIG. 7 shows in a manner analogous to FIG. 1 an alternative embodiment of the arrangement according to the invention.

Another advantageously developed embodiment is illustrated in FIG. 7. The starter bar, which is laterally provided with rollers, is guided between two [-profiles which face each other with their open sides. They form a sliding path 22' arranged somewhat below the level of the casting platform 21.

The transition between the sliding path 22' and the introduction opening in the guiding structure, which opening is created when the bending zone 2 has been pivoted about a bolt 43 by means of a pressure medium cylinder 44, is bridged by the arcuate front end part 45 of the sliding path 22'. This end part 45 is rigidly secured to the arc-inner side of the bending zone 2. When the bending zone 2 is pivoted out, the end part 45 moves into the introduction position which is illustrated in full lines.

Figure 8:
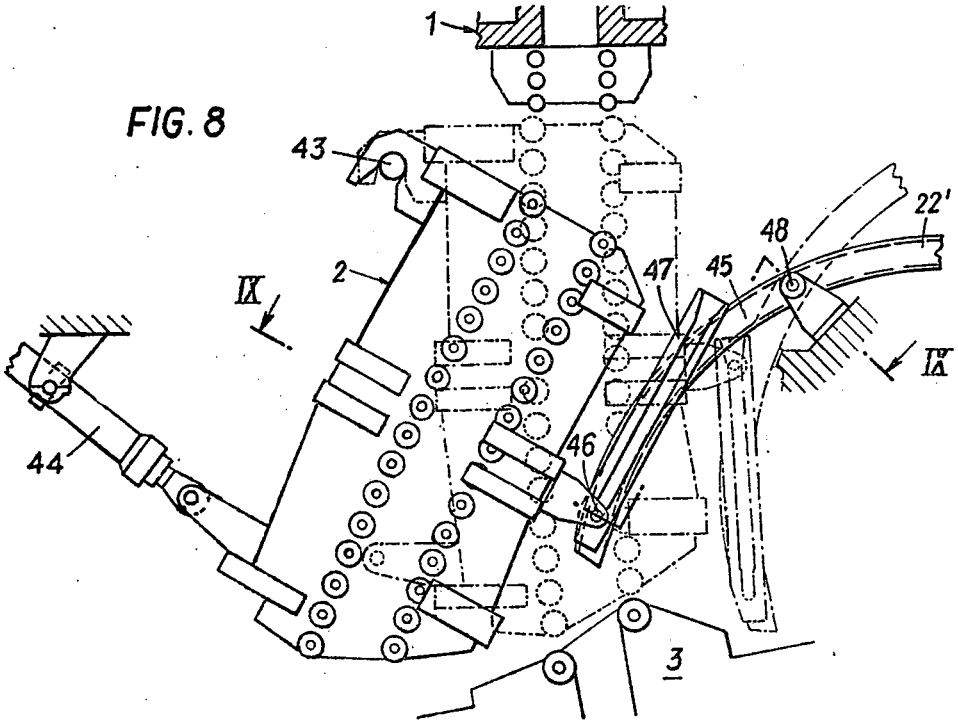
FIGS. 8 and 10 illustrate two further embodiments in illustrations analogous to that of FIG. 6, but on an enlarged scale.
Figure 9:
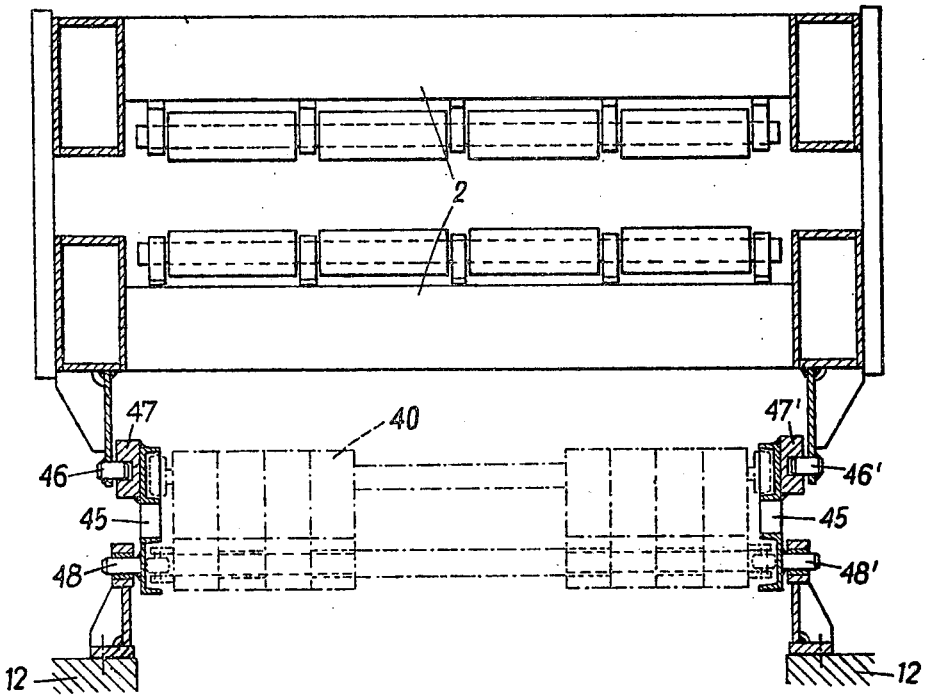
FIG. 9 is a section along line IX—IX of FIG. 8.

According to the embodiment illustrated in FIGS. 8 and 9, (the introduction position here is also indicated in full lines and the casting position in broken lines), two oppositely arranged sliding blocks 46 and 46' rigidly mounted on the bending zone 2 each engage in link guides 47 and 47' mounted at both sides of the arcuate front end part 45 of the sliding path 22'. The end part 45 is pivotable about the bearing pins 48 and 48' mounted on the stationary structure of the continuous casting plant.

Figure 10:
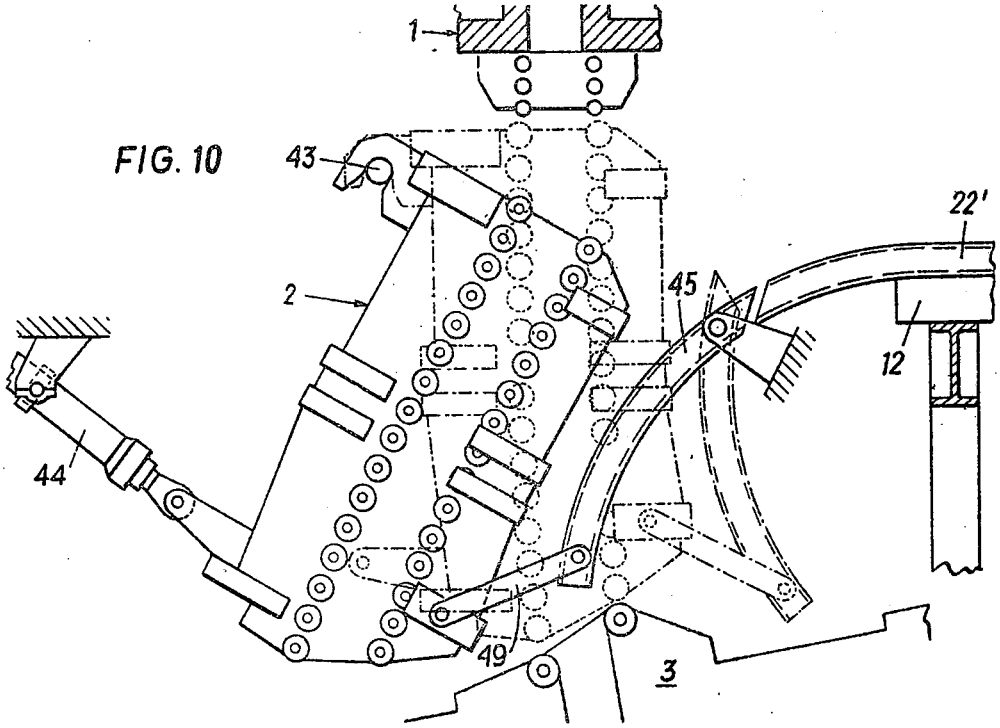

According to the embodiment illustrated in FIG. 10, the motion-coupling between the bending zone 2 and the end part 45 of the sliding path 22' is effected by a guide rod 49.

We claim:

1. In an arrangement for introducing a flexible starter bar, having a foot end, a head end and a starter bar head, into a continuous casting plant system of the type including a stationary supporting structure, a casting platform with a mould located on the structure, a strand guide arranged below the mould, a lifting means provided on the structure for gripping and lifting the starter bar, and a displacement means designed as a car traveling on the supporting structure and arranged to transport the starter bar and to introduce it into the continuous casting plant system, the improvement comprising a conveying means forming a conveying path whose center is stationary, which conveying means is arranged on the stationary supporting structure extending from the lifting means to the strand guide, the starter bar being guided on the conveying path by the displacement means, the conveying means having an arcuate front end part and an arcuate rear end part, and the arcuate front end part of the conveying means being pivotable into and out of an introduction position.

2. An arrangement as set forth in claim 1, wherein the starter bar is introduced into the continuous casting plant system through the mould.

3. An arrangement as set forth in claim 1, wherein the starter bar is introduced into the continuous casting plant system through the strand guide.

4. An arrangement as set forth in claim 1, wherein the conveying means is in the form of a sliding surface and the conveying path is a sliding path.

5. An arrangement as set forth in claim 1, wherein the conveying means is in the form of rollers and the conveying path is a roller path.

6. An arrangement as set forth in claim 1, wherein the conveying path is arranged above the casting platform.

7. An arrangement as set forth in claim 1, wherein the lifting means is united with the displacement means.

8. An arrangement as set forth in claim 7, wherein the lifting means is designed as a cable pull.

9. An arrangement as set forth in claim 7, wherein the lifting means is designed as a chain hoist.

10. An arrangement as set forth in claim 7, further comprising a receiving hook provided on the lifting means for gripping the foot end of the starter bar.

11. An arrangement as set forth in claim 10, further comprising a transverse bolt provided at the foot end of the starter bar.

12. An arrangement as set forth in claim 1, wherein the center of the conveying path extends horizontally, the displacement means is provided with a receiving hook for gripping the foot end of the starter bar, and the strand guide comprises driven rollers, the displacement means being movable along the horizontal conveying path between four positions, (a) a rear starting position, in which the foot end of the starter bar is lifted to the level of the conveying path, (b) a pre-determined unlatched position reached after movement along the conveying path towards the mould to a location where the receiving hook can be unlatched from the foot end of the starter bar, (c) a delivery position reached after movement away from the mould to a location between the rear starting position and the unlatch position, the catch of the displacement means being engageable in the head end of the starter bar in said delivery position, and (d) a final position reached after movement towards the mould to a location in which the foot end of the starter bar is gripped by the driven rollers of the strand guide.

13. An arrangement as set forth in claim 8, wherein the center of the conveying path extends horizontally and further comprising:

a receiving hook provided on the cable pull for gripping the foot end of the starter bar;

a tie-bar to which the cable pull is secured; and a stationary guide for the lifting means extending to the horizontally extending conveying path, in which stationary guide the tie-bar is guided at its ends, the displacement means being provided with a corresponding guide for accommodating the tie-bar and the receiving hook, which displacement means guide is movable together with the displacement means.

14. An arrangement as set forth in claim 9, wherein the center of the conveying path extends horizontally and further comprising:

a receiving hook provided on the chain hoist for gripping the foot end of the starter bar;

a tie-bar to which the chain hoist is secured; and a stationary guide for the lifting means extending to the horizontally extending conveying path, in which stationary guide the tie-bar is guided at its ends, the displacement means being provided with a corresponding guide for accommodating the tie-bar and the receiving hook, which displacement means guide is movable together with the displacement means.

15. An arrangement as set forth in claim 12, further comprising unlatch means provided on the conveying means at the unlatch position for pivoting up the last member of the foot end of the flexible starter bar.

16. An arrangement as set forth in claim 1, further comprising a receiving hook provided on the lifting means for gripping the foot end of the starter bar and a stop provided on the displacement means for preventing a premature unlatching of the receiving hook.

17. An arrangement as set forth in claim 1, further comprising lateral guiding elements provided along the conveying path.

18. An arrangement as set forth in claim 17, wherein said lateral guiding elements are vertical rollers.

19. An arrangement as set forth in claim 1, further comprising double guide rods hinging the arcuate front end part of the conveying means to said stationary supporting structure.

20. An arrangement as set forth in claim 3, wherein the conveying path is arranged at the level of the casting platform, a part of the conveying path being designed as an inclined plane and extending from the level of the casting platform to the pivotable front end part of the conveying means.

21. An arrangement as set forth in claim 3, wherein the strand guide comprises a pivotable part at a distance below the mould, the pivotal part of the strand guide being adapted to create an introduction opening in the strand guide, and wherein the arcuate front end part of the conveying means is motion-coupled with said pivotable part of the strand guide.

22. An arrangement as set forth in claim 20, wherein the strand guide comprises a pivotable part at a distance below the mould, the pivotable part of the strand guide being adapted to create an introduction opening in the strand guide, and wherein the arcuate front end part of the conveying means is motion-coupled with said pivotable part of the strand guide.

23. An arrangement as set forth in claim 21, wherein the arcuate front end part of the conveying means is directly connected to the pivotable part of the strand guide.

24. An arrangement as set forth in claim 21, further comprising a guide rod connection between the arcuate front end part of the conveying means and the pivotable part of the strand guide.

25. An arrangement as set forth in claim 21, further comprising a link guide for connecting the arcuate front end part of the conveying means with the pivotable part of the strand guide.

26. An arrangement as set forth in claim 25, further comprising a sliding block provided on the inner side of the pivotable part of the strand guide for engagement with the link guide, the link guide being fixedly connected to the arcuate front end part of the conveying means.

* * * * *

UNITED STATES PATENT OFFICE

CERTIFICATE OF CORRECTION

Patent No. 4,114,679 Dated September 19, 1978

Inventor(s) Loibl et al.

It is certified that error appears in the above-identified patent and that said Letters Patent are hereby corrected as shown below:

Col. 1, line 57, "accurately" should read --arcuately--.

Col. 3, line 26, "EXAMPLARY" should read --EXEMPLARY--;

line 50, "is divided" should read --so as to divide--;

line 63, "strater" should read --starter--.

Col. 4, line 11, "structur" should read --structure-- and "a" should be deleted;

line 55, "unlatached" should read --unlatched--.

Col. 6, line 35, "unlatched" should read --unlatch--.

Signed and Sealed this

Ninth Day of January 1979

[SEAL]

Attest:

RUTH C. MASON
Attesting Officer

DONALD W. BANNER
Commissioner of Patents and Trademarks